US006386262B1

(12) United States Patent
McLaughlin

(10) Patent No.: US 6,386,262 B1
(45) Date of Patent: May 14, 2002

(54) FLEXIBLE ELEVATED RETRACTABLE SCREEN ENCLOSURE

(76) Inventor: Maxwell John McLaughlin, OS 510 Cornell Ave., Villa Park, IL (US) 60181

( * ) Notice: Subject to any disclaimer, the term of this patent is extended or adjusted under 35 U.S.C. 154(b) by 0 days.

(21) Appl. No.: 09/752,852

(22) Filed: Jan. 2, 2001

(51) Int. Cl.[7] ..... E06B 3/48
(52) U.S. Cl. ..... 160/113; 160/201
(58) Field of Search ..... 160/113, 201, 160/87, 89, 90, 102, 103, 118, 205

(56) References Cited

U.S. PATENT DOCUMENTS

| | | | | | |
|---|---|---|---|---|---|
| 3,021,896 | A | * | 2/1962 | Buono et al. | 160/113 |
| 3,103,967 | A | * | 9/1963 | Gaschen | 160/113 |
| 3,126,944 | A | * | 3/1964 | Kempinski | 160/113 X |
| 3,938,577 | A | * | 2/1976 | Richards | 160/113 X |
| 4,231,412 | A | | 11/1980 | Nowak | 160/213 |
| 4,378,043 | A | | 3/1983 | Sorenson | 160/97 |
| 4,653,566 | A | | 3/1987 | Miale | 160/201 |
| 4,673,019 | A | | 6/1987 | Silverthorne et al. | 160/268 |
| 4,770,087 | A | | 9/1988 | Danley et al. | 98/87 |
| 4,846,241 | A | | 7/1989 | Chomka et al. | 160/23.1 |
| 5,050,660 | A | * | 9/1991 | Bleichwehl et al. | 160/113 |
| 5,123,474 | A | | 6/1992 | Smith | 160/310 |
| 5,323,835 | A | | 6/1994 | Bachmeier | 160/89 |
| 5,427,169 | A | | 6/1995 | Saulters | 160/368.1 |
| 5,611,382 | A | | 3/1997 | Sferra | 160/113 |
| 5,848,630 | A | * | 12/1998 | Manzo | 160/113 |

* cited by examiner

*Primary Examiner*—David M. Purol

(57) ABSTRACT

A flexible retractable screen assembly is disclosed for any garage door of the type that ends with the garage door substantially parallel to a garage floor when in a fully opened condition. The assembly includes a frame sub-assembly with bases 21R, 21L, 31R, 31L symmetrically disposed in the corners of an entire interior side of a garage door. Vertically positioned flexible track members 41L, 41R disposed at opposite ends of garage door are mounted, elevated off door to traverse an entire height of garage door, in respective end corner bases 21R, 31R or 21L, 31L. Flexible dual-purpose conjunctive rods 60L, 60R, disposed at opposite ends, slidably engages respective tracks 41L, 41R and screen sub-assembly attachment slips 90L, 90R. Fixedly attached to each rod 60L, 60R above and below screen sub-assembly attachment slips 90L, 90R to restrict their movement are respectively, a horizontal support brace 82 and a concert drag 72. A rod end 63L of each respective rod 60L, 60R increases in dimension and acts as a wedge to releasably lock each rod 60L, 60R in its respective track 41l, 41R, during operation of a garage door. A single screen panel sub-assembly consists of attachment slips 90L, 90R, vertically positioned disposed at opposite ends on vertical seams 37L, 37R between a main portion 99 and each of an adjacent side auxiliary portions 92L, 92R, and an adjacent upper auxiliary portion 96. When in a deployed condition, hook and loop fasteners are used to enclose openings, not enclosed by main portion 99, at top between bottom panel of a garage door (not shown) and a header of a garage door jam (not shown) and at sides as rods 60L, 60R telescope bowing outwardly from tracks 41L, 41R and back to engage a garage floor (not shown).

10 Claims, 9 Drawing Sheets

42U
48
46U
IV
55U
44U
43U
45U
56U
49U
47
41R or 41L
V
45L
III
46L
55L
42L
56L
44L
52
59
57
54
53
58

45U
42U
56U 49L
43L

FLEXIBLE ELEVATED RETRACTABLE SCREEN ENCLOSURE

BACKGROUND—FIELD OF INVENTION

This invention relates to a garage door screen assembly, specifically to an improved mounting configuration for a single screen panel retractably mounted substantially across the entire interior surface of any garage door that ends in a fully opened condition substantially parallel to a floor of a garage.

BACKGROUND—DISCUSSION OF PRIOR ART

Many residential garages do not have windows or the windows do not provide an opening sufficient to properly ventilate a large garage. Generally, the air inside the garage tends to stagnate and get quite hot, particularly during summer months and in southern climates. Additionally, the interior of the garage tends to collect obnoxious odors from elements exposed to or stored within the garage such as, automobile exhaust, skinned squirrel or cat carnage, or trash or garbage. Historically, the best way to ventilate a large garage was to leave the overhead door open. However, if no barrier is in place, festive activities can become very unpleasant when insects attracted by the food or the body heat of the participants join the party.

Thereafter, inventors created several types of screen enclosures for garage door openings. Historically, screen enclosures could be grouped into the following categories: free-standing, roll-up, or interior mounted. The free-standing enclosures were completely separate from the garage and had to be positioned in a garage door opening usually requiring attachment to the exterior of the garage door jam. Therefore, free-standing enclosures may have required multiple persons to deploy or an additional space to store. Storage concerns were addressed by both roll-up and interior mounted type enclosures. The roll-up types were mounted to the structural elements of a garage, which required knowledge of such.

Two types of screen devices affixed to an interior surface of a garage door have been proposed—for example, U.S. Pat. No. 5,611,382 to Sferra (1997) and U.S. Pat. No. 4,653,566 to Miale (1987). Although convenient to store, deployable at a plurality of heights, and retractable by complimentary rigid slide members firstly attached to a garage door, such screen assemblies are limited by the following:

(a) Conventional track members cannot traverse the entire height of a garage door due to their lack of flexibility to negotiate bends associated with the operation of a sectional garage door;

(b) The height of potentially crossing inherent garage door connecting or supporting means obstructs a line of sight of a track when firstly attached to a garage door;

(c) The length of run of a track restricts the height of a screen panel that can be utilized;

(d) Unless part of a garage door is relatively perpendicular to a floor when open, parallel rigid panels successively slidably mounted to one another cannot properly depend from a garage door to a floor;

(e) With telescoping screen panels, the lower screen panel is incrementally further from a garage door than a preceding screen panel creating an increasing gap at the ends as more panels are utilized;

(f) Any bolts perforating a garage door to secure a screen device to the interior side of the garage door decreases the efficiency of the door to insulate and act as a thermal barrier.

SUMMARY

In accordance with the present invention described and claimed herein comprises a frame subassembly with bases symmetrically disposed in the corners of an entire interior side of a garage door; flexible track members disposed at opposite ends vertically positioned traversing entire height of garage door mounted in respective end corner bases; flexible dual-purpose conjunctive rods disposed at opposite ends slidably engage respective tracks and screen sub-assembly attachment slips; fixedly attached to each rod above and below screen subassembly attachment slips to restrict their movement are respectively, a horizontal support brace and a concert drag, and a screen sub-assembly with attachment slips vertically positioned disposed at opposite ends of a main portion, and two adjacent side auxiliary portions and an adjacent upper auxiliary portion that enclose openings via hook and loop fasteners at sides as rods telescope from tracks to engage a garage floor and between garage door and header at top when garage door is in a raised condition.

OBJECTS AND ADVANTAGES

Accordingly, besides the objects and advantages of the screen assemblies described in my above patent, several objects and advantages of the present invention are:

(a) to provide unconventional fabricated components of predetermined dimension to allow imperforate mounting of track elevated parallel to the interior side of a garage door and to allow screen assembly to traverse entire height of a garage door;

(b) to provide a garage door screen assembly that employs a single screen panel that stores neatly, compactly and permanently against the interior of the garage door so that garage clutter is reduced;

(c) to provide wedge principal means to releasably lock telescoping fabricated components of predetermined dimension;

(d) to provide a screen assembly for a garage door that is permanently and retractably mounted to the interior of the garage door but which does not interfere with or affect the operation of the door when use of the screen assembly is not required;

(e) to provide a screen assembly for a garage door that is conveniently designed to allow easy manual operation;

(f) to provide a screen assembly for a garage door that significantly improves air circulation and lighting, while still maintaining privacy within the garage.

This invention results from a realization that an improved garage door screen assembly can be accomplished by the imperforate mounting of a retractable frame subassembly to an interior side of a garage door. The frame sub-assembly is further attached to a single screen panel subassembly. The screen sub-assembly consists of attachment slips mounted to a main portion with auxiliary portions attached vertically at its side ends and horizontally at its top. Furthermore, using lightweight material of superior strength to fabricate unique parts of predetermined dimension allows manual means, wedge principal means, and adhesive means to be the most effective means to, respectively, deploy, releasably lock, and attach a screen assembly. The invention features a retractable screen assembly for any garage door that ends in a fully opened condition substantially parallel to a floor of a garage.

Further objects and advantages are to provide a garage door screen assembly which can be quickly and reliably deployed when needed to prevent leaves, insects, and pests from entering the garage, economically manufactured, and utilized as a personal billboard. To date no other garage screen assembly stores by permanent imperforate mounting to an interior surface of a garage door and encloses all breaches created by a door in a fully raised condition with a single screen panel. Still further objects and advantages will become apparent from a consideration of the ensuing description and drawings.

DRAWING FIGURES

In the drawings, closely related figures have the same number but different alphabetic suffixes.

Figure 1:
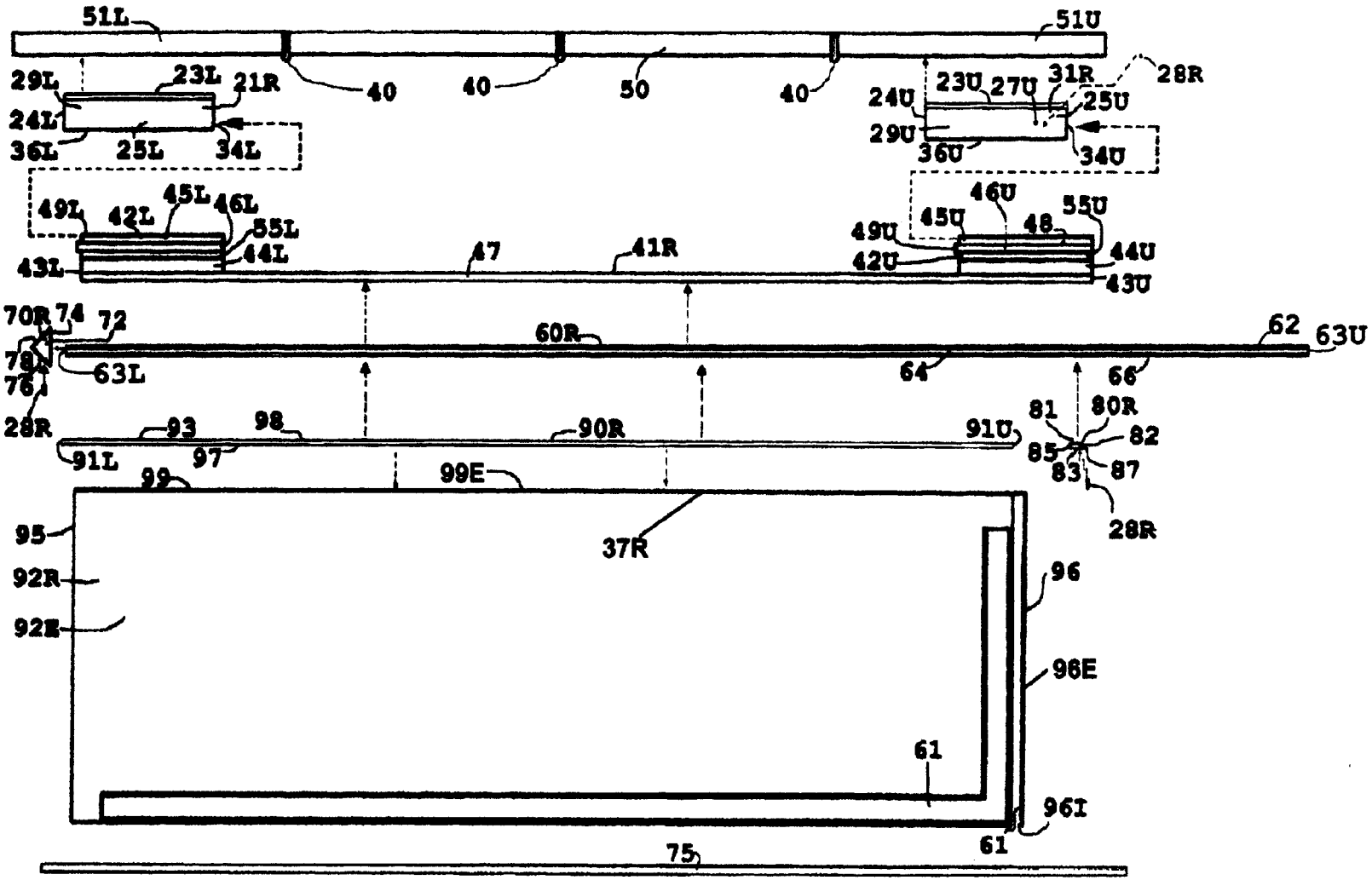
FIG. 1 is an exploded side view of parts of the total improved garage screen assembly of the present invention in a relaxed condition relatively positioned to a sectional garage door.

| Reference Numerals in Drawings | |
|---|---|
| 21L | A lower base at left end |
| 21R | A lower base at right end |
| 22L | A front stabilizing notch of lower bases |
| 22U | A front stabilizing notch of upper bases |
| 23L | Contacting plate of lower bases |
| 23U | Contacting plate of upper bases |
| 24L | A front side of cradle of lower bases |
| 24U | A front side of cradle of upper bases |
| 25L | Cradle of lower bases |
| 25U | Cradle of upper bases |
| 26L | An upper cavity of lower bases |
| 26U | An upper cavity of upper bases |
| 27U | Hole of cradle of upper bases |
| 28L | A pin at left side |
| 28R | A pin at right side |
| 29L | A right side of cradle of lower bases |
| 29U | A right side of cradle of upper bases |
| 30L | A left side of cradle of lower bases |
| 30U | A left side of cradle of upper bases |
| 31L | An upper base at left end |
| 31R | An upper base at right end |
| 32L | A right side stabilizing cavity of lower bases |
| 32U | A right side stabilizing cavity of upper bases |
| 33L | A slot of lower bases |
| 33U | A slot of upper bases |
| 34L | A rear side of cradle of lower bases |
| 34U | A rear side of cradle of upper bases |
| 35L | A left side stabilizing cavity of lower bases |
| 35U | A left side stabilizing cavity of upper bases |
| 36L | A base side of cradle of lower bases |
| 36U | A base side of cradle of upper bases |
| 37L | A vertical seam of single screen panel at left side |
| 37R | A vertical seam of single screen panel at right side |
| 38L | A receiver well of lower bases |
| 38U | A receiver well of upper bases |
| 39L | A lower cavity of lower bases |
| 39U | A lower cavity of upper bases |
| 40 | An inherent garage connection or support |
| 41L | A vertical track at left end |
| 41R | A vertical track at right end |
| 42L | A lower rigid footing of tracks |
| 42U | An upper rigid footing of tracks |
| 43L | A lower end of vertical tracks |
| 43U | An upper end of vertical tracks |
| 44L | A lower rigid tower of tracks |
| 44U | An upper rigid tower of tracks |
| 45L | An upper arm of lower footing of tracks |
| 45U | An upper arm of upper footing of tracks |
| 46L | A right stabilizing arm of lower footing of tracks |
| 46U | A right stabilizing arm of upper footing of tracks |
| 47 | An elongated flexible substantially cylindrical barrel housing of tracks |
| 48 | A hole of upper footing of tracks |
| 49L | A front stabilizing arm of lower footing of tracks |
| 49U | A front stabilizing arm of upper footing of tracks |
| 50 | A sectional garage door |
| 51L | A lower panel of sectional garage door |
| 51U | An upper panel of sectional garage door |
| 52 | A cap portion of bore |
| 53 | A stem portion of bore |
| 54 | An exterior circumference of barrel housing of tracks |
| 55L | A lower arm of lower footing of tracks |
| 55U | A lower arm of upper footing of tracks |
| 56L | A left stabilizing arm of lower footing of tracks |
| 56U | A left stabilizing arm of upper footing of tracks |
| 57 | An elongated aperture created by breaching bore of tracks |
| 58 | A gauge of aperture of tracks |
| 59 | A mushroom-shaped breaching bore |
| 60L | A dual-purpose conjunctive frame rod at left end |
| 60R | A dual-purpose conjunctive frame rod at right end |
| 61 | One half of a hook and loop fastener |
| 62 | An upper segment of conjunctive rods |
| 63L | A lower end of conjunctive rods |
| 63U | An upper end of conjunctive rods |
| 64 | A middle segment of conjunctive rods |
| 66 | A lower segment of conjunctive rods |
| 68 | A left side of vertical screen attachment slips |

-continued

| Reference Numerals in Drawings | |
|---|---|
| 69 | A lateral cross-sectional conformation of rods |
| 70L | A left end of a horizontal drag |
| 70R | A right end of a horizontal drag |
| 71L | A depression in drag at left end |
| 71R | A depression in drag at right end |
| 72 | A horizontal drag |
| 73 | A perimeter of depression of drag |
| 74 | A base side of a horizontal drag |
| 75 | A garage floor |
| 76 | A right leg side of a horizontal drag |
| 77H | A head segment of rods |
| 77T | A tail segment of rods |
| 78 | A left leg side of a horizontal drag |
| 79L | A hole of drag at left end |
| 79R | A hole of drag at right end |
| 80L | A left end of a horizontal brace |
| 80R | A right end of a horizontal brace |
| 81 | A top side of a horizontal brace |
| 82 | A horizontal brace |
| 83 | A bottom side of a horizontal brace |
| 84 | An interior perimeter of groove of vertical screen attachment slips |
| 85 | A front side of a horizontal brace |
| 86 | An interior perimeter of grooves of brace |
| 87 | A rear side of a horizontal brace |
| 88L | A hole of brace at left end |
| 88R | A hole of brace at right end |
| 89L | A latitudinal groove of brace at left end |
| 89R | A latitudinal groove of brace at right end |
| 90L | A flexible vertical screen attachment slip at left side |
| 90R | A flexible vertical screen attachment slip at right side |
| 91L | A lower end of screen attachment slips |
| 91U | An upper end of screen attachment slips |
| 92E | An exterior side of side portions of single screen panel |
| 92L | A left side portion of single screen panel |
| 92R | A right side portion of single screen panel |
| 93 | A top side of vertical screen attachment slips |
| 94 | A longitudinal groove of vertical screen attachment slips |
| 95 | A flexible single screen panel |
| 96 | An upper portion of single screen panel |
| 96E | An exterior side of upper portion of single screen panel |
| 96I | An interior side of upper portion of single screen panel |
| 97 | A bottom side of vertical screen attachment slips |
| 98 | A right side of vertical screen attachment slips |
| 99 | A main portion of single screen panel |
| 99E | An exterior side of main portion of single screen panel |

DESCRIPTION—PREFERRED EMBODIMENT

Referring to FIG. 1, shown are the parts when concerted comprise the screen assembly of the present invention in relational position to a sectional garage door 50 substantially parallel to a garage floor 75. A fabricated lower base 21R is shown positioned below its incorporation point on a lower panel 51L of said garage door 50. A supplementary identical lower base 21L incorporated horizontally at an opposite end of said garage door 50 is not shown in FIG. 1. (See FIG. 2) Said lower bases 21R, 21L consist of a contacting plate 23L, and a cradle 25L. Said cradle 25L has shown front 24L, rear 34L, base 36L, and right 29L sides. A fabricated upper base 31R is shown positioned below its incorporation point on an upper panel 51U of said garage door 50. A supplementary identical upper base 31L incorporated horizontally at an opposite end of said garage door 50 is not shown in FIG. 1. (See FIG. 2) Said upper bases 31R, 3IL consist of a contacting plate 23U, a cradle 25U, and a hole 27U through said cradle 25U. Said 25U has shown a front 24U, rear 34U, base 36U, and right 29U sides. Shown is a fabricated track 41R which has a pair of rigid footings 42L, 42U and towers 44L, 44U located at opposite ends 43L, 43U of a substantially cylindrical elongated flexible barrel housing 47, and a hole 48 through the upper footing 42U. Said footings 42L, 42U include an upper arm 45L, 45U, a lower arm 55L, 55U, a front stabilizing arm 49L, 49U, and a right stabilizing arm 46L, 46U. A supplementary identical track 41L incorporated parallel to the above track 41R at an opposite end of said garage door 50 is not shown in FIG. 1. (See FIG. 2) A fabricated flexible dual-purpose conjunctive frame rod 60R is shown positioned below its incorporation point in said track 41R. Said rod 60R has a predetermined length greater than that of said track 41R, an upper segment 62, a middle segment 64, a lower segment 66, and two ends 63L, 63U. A supplementary identical rod 60L incorporated parallel to the above rod 60R at an opposite end of said garage door 50 is not shown in FIG. 1. (See FIG. 2) An end 70R of a fabricated horizontal drag 72 is shown at its relative incorporation point on the end 63L of said rod 60R Said drag 72 has shown a base 74, right leg 76, and left leg 78 sides. An end 80R of a fabricated horizontal brace 82 is shown at its relative incorporation point on the lower segment 66 of said rod 60R. Said brace 82 has shown a top 81, bottom 83, front 85, and rear 87 sides. A fabricated flexible vertical screen attachment slip 90R is shown between its relative incorporation points, respectively, on the lower segment 66 of said rod 60R between said drag 72 and said brace 82, and on a vertical seam 37R of a single screen panel 95. A supplementary identical screen attachment slip 90L incorporated parallel to the above slip 90R at an opposite end of screen panel 95 is not shown in FIG. 1. (See FIG. 3) Said slip 9OR has shown two ends 91L, 91U, a top 93, bottom 97, and right 98 sides. A single screen panel 95 is shown draping at its relative incorporation point on said bottom side 97 of said slip 90R. Said screen panel 95 consists of a main portion 99, two side portions 92R, 92L, the opposite side portion 92L not shown in FIG. 1 (See FIG. 3), and an upper portion 96. Said upper portion 96 has both an exterior side 96E and an interior side 96I. One half of a hook and loop fastener 61 is attached to an exterior side 92E of said side portions 92R, 92L and to said interior side 96l of said upper portion 96. A pin 28R is shown at incorporation junctions between said upper base 31R and said track 41R, said rod 60R and said drag 72, and said rod 60R and said brace 82. A supplementary identical pin 28L for junctions at other end of said garage door 50 is not shown in FIG. 1. (See FIG. 2) All above parts are more thoroughly described below.

Figure 2:
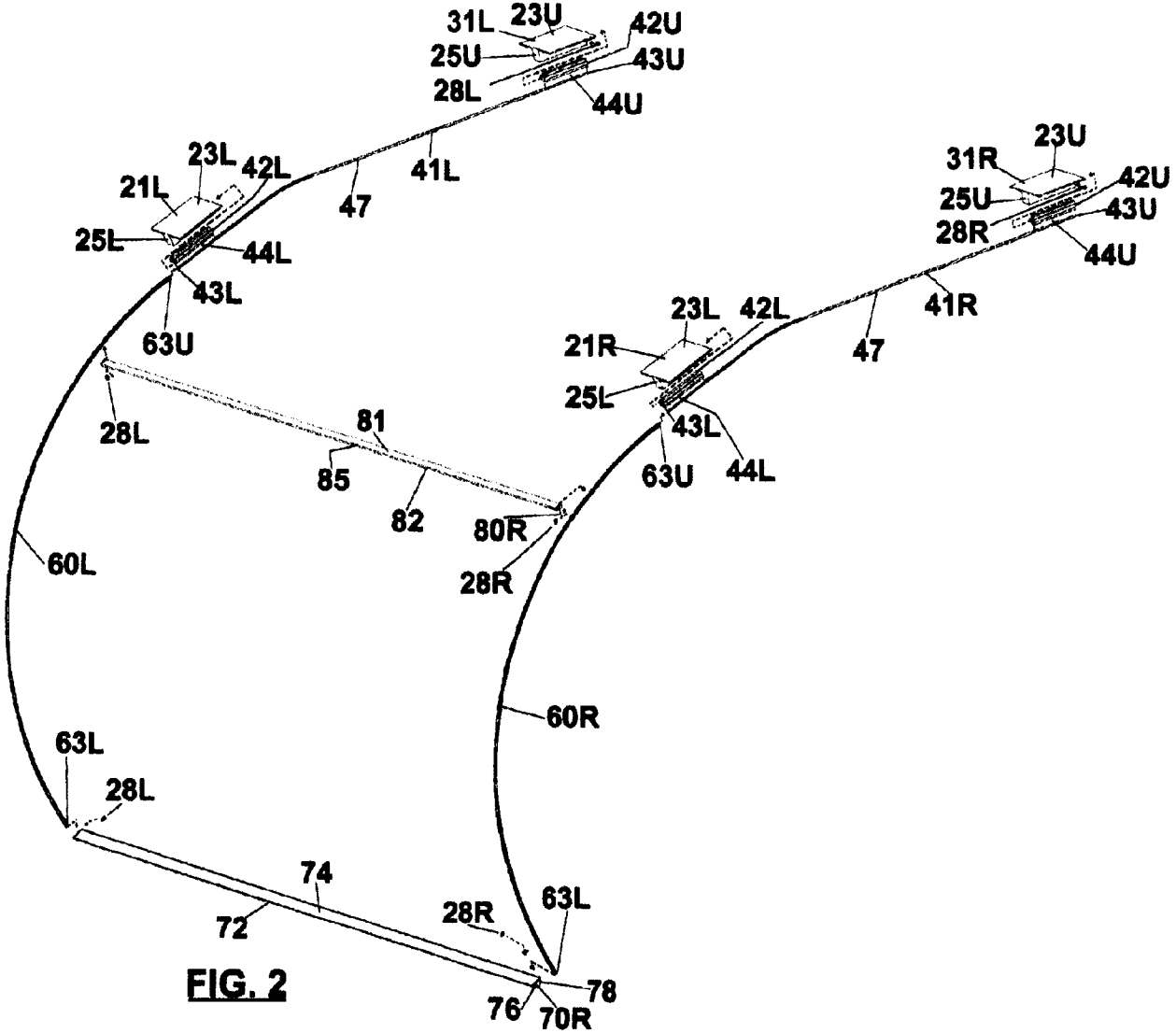
FIG. 2 is a distant exploded left elevation perspective view of parts of the frame subassembly of the present invention in an extended and flexed condition.

Referring to FIG. 2, shown are the parts that comprise the frame subassembly of the present invention. Said bases 21R, 21L, 31R, 31L are shown as if disposed in the corners of a sectional garage door which has been removed for the sake of simplicity. Disposed below either pair of said bases 21R, 3lR or 21L, 31L is respective said track 41R or 41L vertically positioned in a flexed condition. Disposed in-line with each said track 41R, 41L is respective said rod 60R or 60L vertically positioned in a flexed condition. Disposed horizontally between said rods 60R, 60L are the horizontal drag 72 and the horizontal brace 82. Said pins 28R, 28L are shown at their incorporation points.

Figure 3:
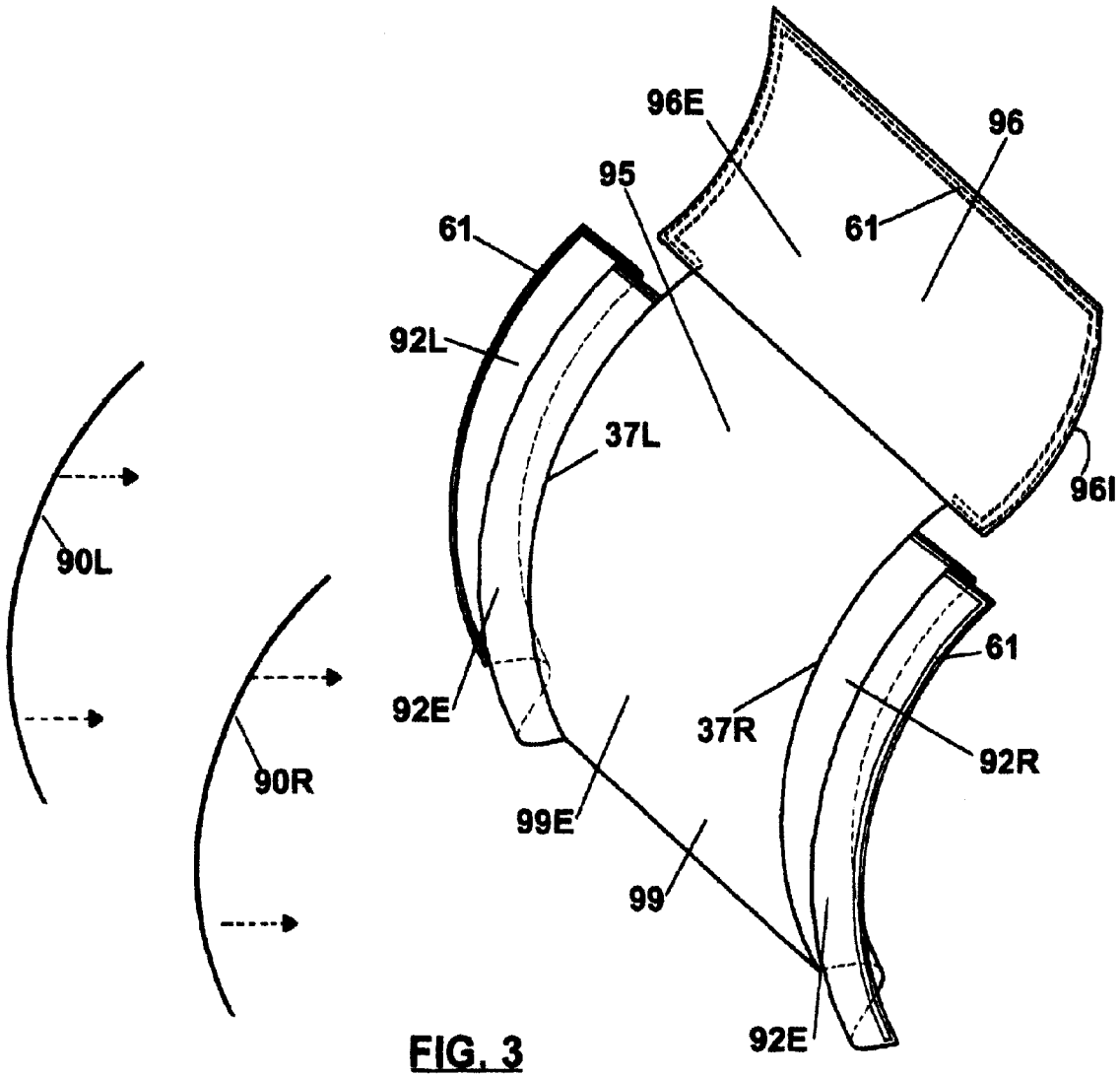
FIG. 3 is a distant exploded left elevation perspective view of parts of the screen sub-assembly of the present invention in a flexed condition.
Figure 4:
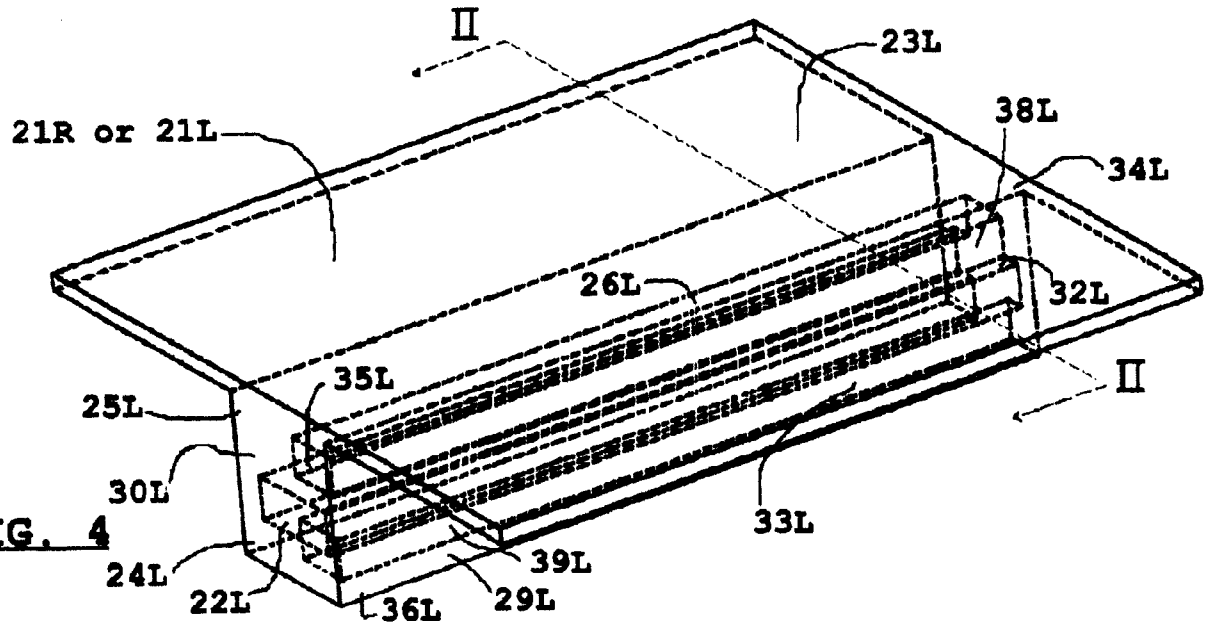
FIG. 4 is a perspective view of parts of the screen assembly shown in FIG. 1 and FIG. 2 laterally crossed by line II_II.
Figure 5:
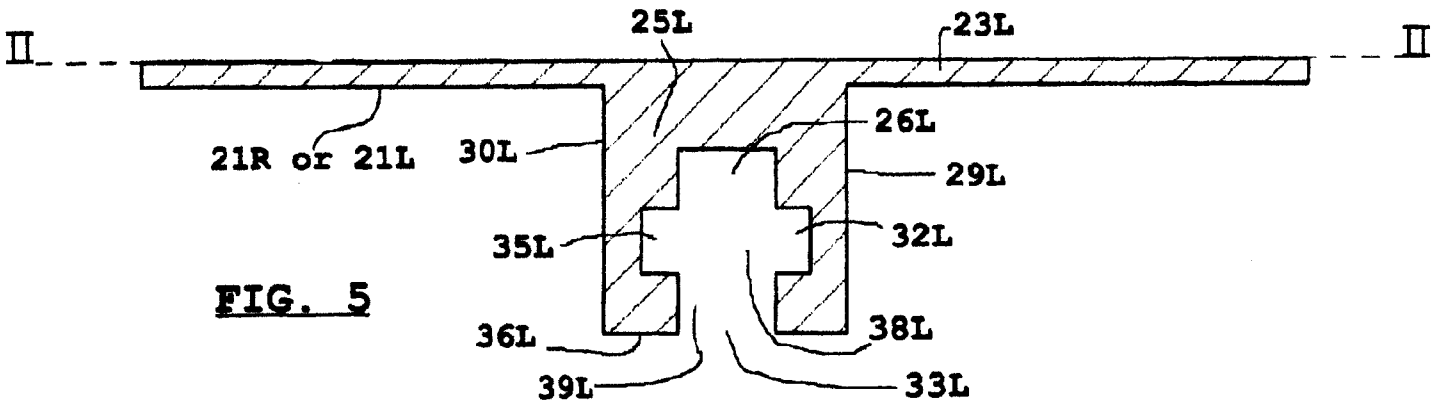
FIG. 5 is a cross-sectional view of FIG. 2 along line II_II.

Referring to FIG. 3, shown are the parts that comprise the screen sub-assembly of the present invention. Said slips 90R, 90L are shown vertically positioned in a flexed condition facing their incorporation points on seams 37R, 37L on an exterior face 99E of said main portion 99. Said screen panel 95 consists of said main portion 99, two said side portions 92R, 92L, and said upper portion 96. One half of a hook and loop fastener 61 is attached to said exterior side 92E of said side portions 92R, 92L and to said interior side 96I of said upper portion 96.

Referring to FIGS. 4, 5, 6, 7, said bases 21R, 21L, 31R, 31L of the preferred embodiment each respectively consists of said contact plate 23L, 23U, said cradle 25L, 25U, and a receiver well 38L, 38U, all of predetermined dimension. Said cradles 25L, 25U each respectively consists of said front side 24L, 24U, said right side 29L, left side 30L, 30U, said rear side 34L, 34U, and said base side 36L, 36U. Said receiver wells 38L, 38U each respectively consist of an upper cavity 26L, 26U, a right side stabilizing cavity 32L, 32U, a left side stabilizing cavity 35L, 35U, and a lower cavity 39L, 39U, all of predetermined dimension. Said cavities 26L, 26U, 32L, 32U, 35L, 35U, 39L, 39U all breach and extend from their respective said rear side 34L, 34U toward their respective said front side 24L, 24U of said cradles 25L, 25U. No said cavity 26L, 26U, 32L, 32U, 35L, 35U, side 24L, 24U. Said left side cavities 35L, 35U and said right side cavities 32L, 32U extend farther than said upper end lower cavities 26L, 26U, 39L, 39U creating front stabilizing notches 22L, 22U of said cradles 25L, 25U. Said lower cavities 39L, 39U breach their respective said base side 36L, 36U of said cradles 25L, 25U creating a slot 33L, 33U equal to the entire length of said lower cavities 39L, 39U. Said upper bases 31R, 31L have said hole 27U through said right side 29U of said cradle 25U to said upper cavity 26U.

Figure 8:
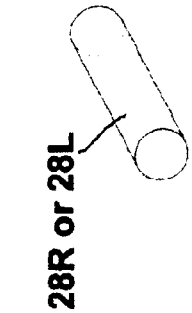
FIG. 8 is a perspective view of parts of the screen assembly shown in FIG. 1 and FIG. 2.
Figure 6:
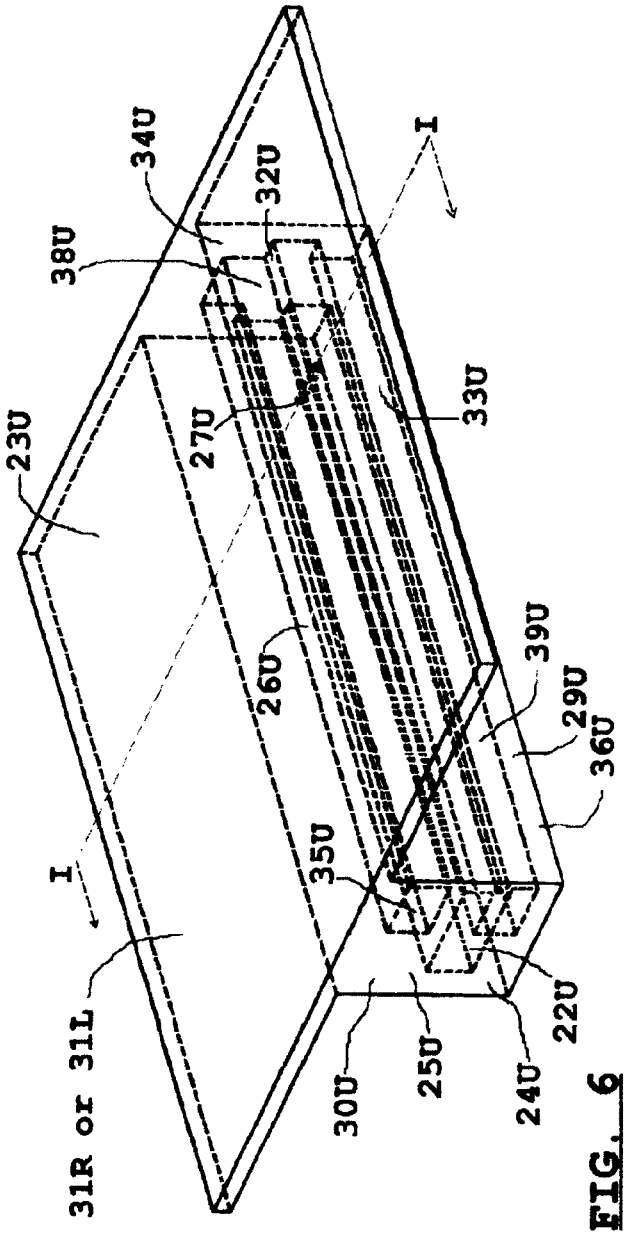
FIG. 6 is a perspective view of parts of the screen assembly shown in FIG. 1 and FIG. 2 laterally crossed by line I_I.
Figure 7:
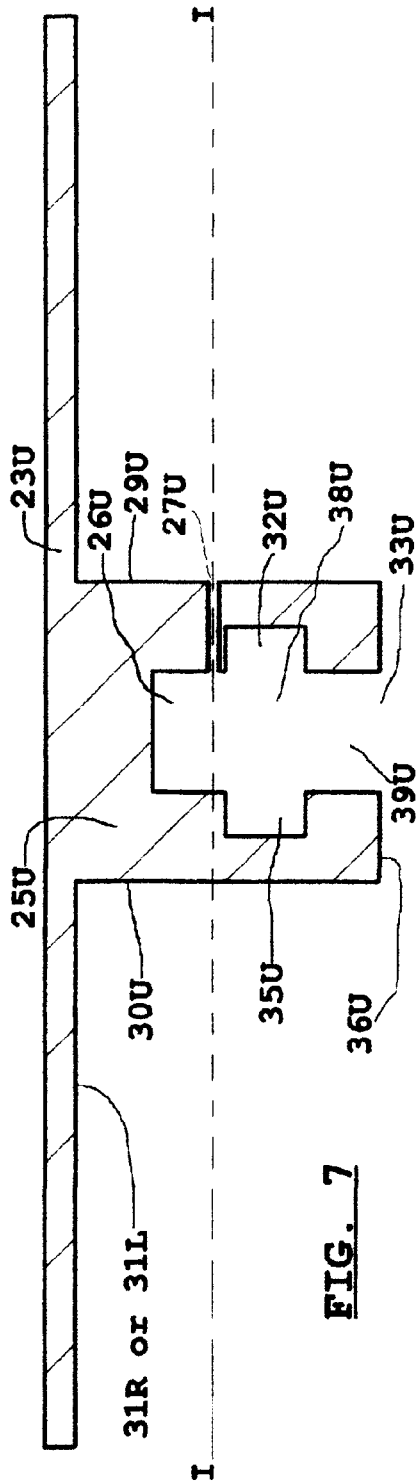
FIG. 7 is a cross-sectional view of FIG. 6 along line I_I.
Figures 9, 10, 11, 12:
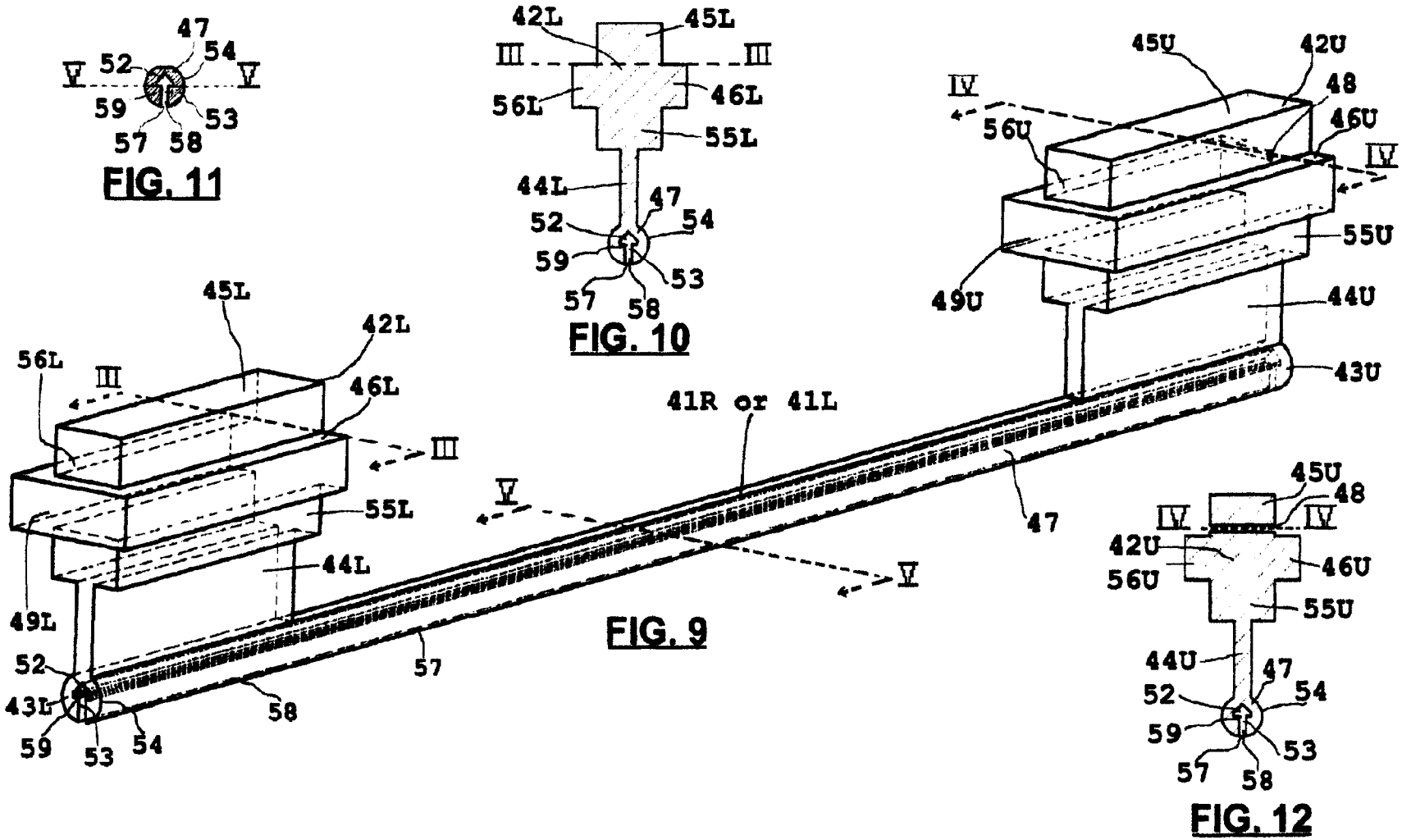
FIG. 9 is a perspective view of parts of the screen assembly shown in FIG. 1 and FIG. 2 laterally crossed by line III_III, V_V, IV_IV.
FIG. 10 is a cross-sectional view of FIG. 9 along line III_III.
FIG. 11 is a cross-sectional view of FIG. 9 along line V_V.
FIG. 12 is a cross-sectional view of FIG. 9 along line IV_IV.

Referring to FIG. 8, said pins 28R, 28L are of predetermined dimension to adequately engage said upper footing 42U of said tracks 41L, 41R to said upper bases 31R, 31L, said drag 72 to said rods 60R, 60L, and said brace 82 to said rods 60R, 60L.

Referring to FIGS. 9,10,11,12, said footings 42L, 42U of said tracks 41R, 41L in the preferred embodiment consist of said upper arms 45L, 45U, said right side stabilizing arms 46L, 46U, left side stabilizing arms 56L, 56U, said front side stabilizing arms 49L, 49U, said lower arms 55L, 55U, and said hole 48 through upper arm 45U, all of predetermined dimension. Said footings 42L, 42U are integrated with said towers 44L, 44U which are of a predetermined height sufficient to allow said barrel housing 47 unimpeded vertical traversal of entire height of said garage door 50 from any inherent supporting or connecting means 40 (In FIG. 1) of said garage door 50. Said barrel housing 47 has a mushroom shaped breaching bore 59, said front end 43L, and said rear end 43U. Said bore 59 has a cap portion 52 located more towards center breaching no part of said barrel housing 47 and a stem portion 53 downwardly running intersecting exterior circumference 54 of said barrel housing 47 creating an aperture 57. Said stem portion 53 is of predetermined dimension, which constitutes a consistent gauge 58 of aperture 57 throughout the elongated barrel housing 47. The material of said barrel housing 47 in the preferred embodiment is one that is flexible but rigid enough not to allow a sufficient variance in said gauge 58 of said aperture 57 to lose integrity as respective said track 41R, 41L to respective said rod 60R, 60L.

Figures 13, 14:
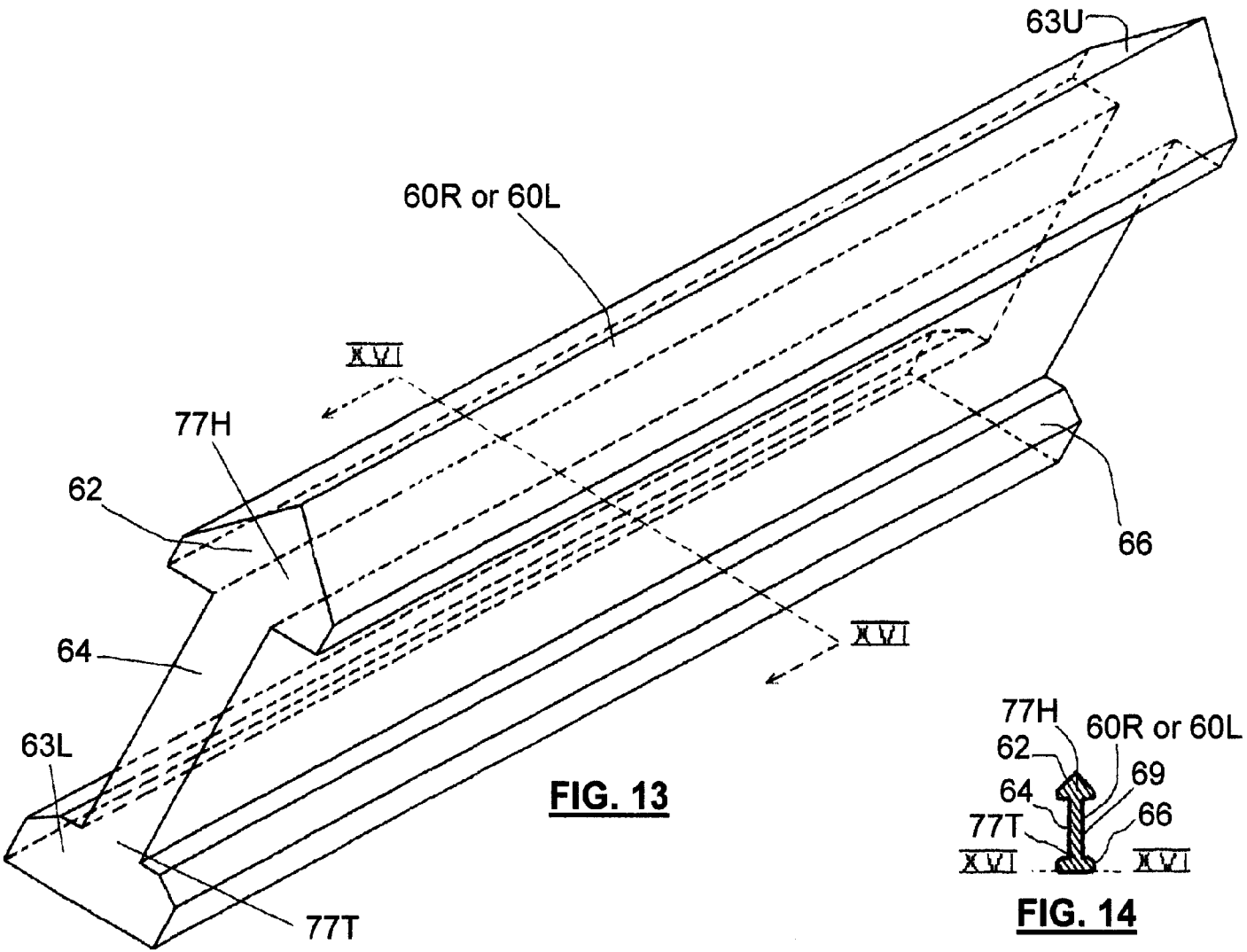
FIG. 13 is a perspective view of parts of the screen assembly shown in FIG. 1 and FIG. 2 laterally crossed by line XVI_XVI.
FIG. 14 is a cross-sectional view of FIG. 13 along line XVI_XVI.

Referring to FIGS. 13, 14, said upper segment 62 of each said rod 60R, 60L is of such predetermined dimension that is wider than that of said middle segment 64, which is of such predetermined dimension that is narrower than that of said lower segment 66. A lateral cross-sectional conformation 69 of said upper 62, middle 64, and lower 66 segments is, therefore, barbell-like in shape, with a middle narrowing. A section of said conformation 69 from said upper segment 62 through half of said middle segment 64 is known as a head segment 77H. A section of said conformation 69 from said lower segment 66 through half of said middle segment 64 is known as a tail segment 77T. Said head segment 77H is shaped to said bore 59 of said tracks 41R, 41L. In the preferred embodiment, said rods 60R, 60L would be fabricated out of material with desired flexible characteristics such as plastic, fiberglass, or rubber.

Figures 15, 16, 17, 18:
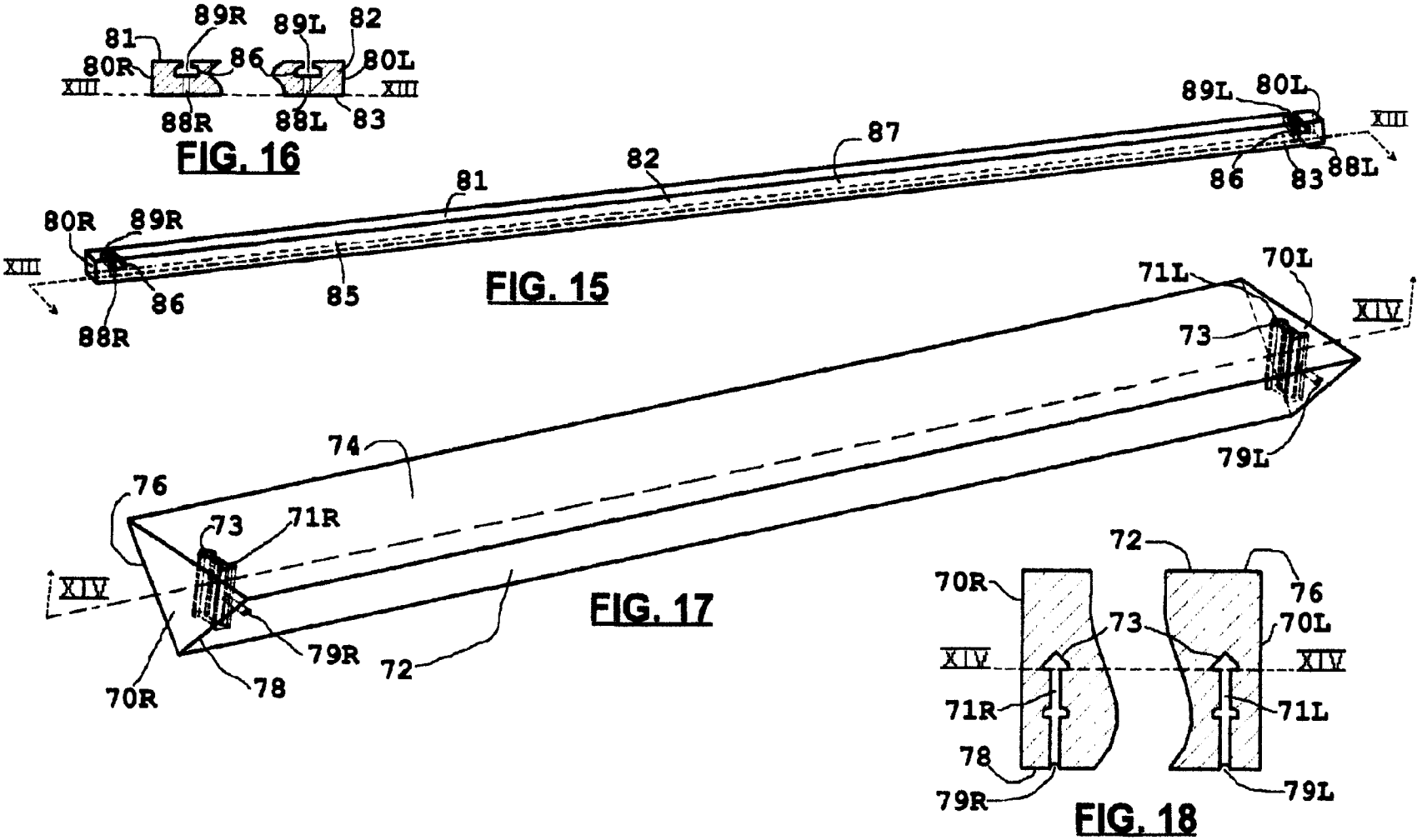
FIG. 15 is a perspective view of a part of the screen assembly shown in FIG. 1 and FIG. 2 longitudinally crossed by line XIII_XIII.
FIG. 16 is a broken cross-sectional view to show ends of FIG. 15 along line XIII_XIII.
FIG. 17 is a perspective view of a part of the screen assembly shown in FIG. 1 and FIG. 2 longitudinally crossed by line XIV_XIV.
FIG. 18 is a broken cross-sectional view to show ends of FIG. 17 along lines XIV_XIV.

Referring to FIGS. 15, 16, said drag 72 consists of said end 70R, an opposite end 70L, said base side 74, and said leg sides 76, 78, all of predetermined dimension. Depressions 71R, 71L each disposed from said ends 70R, 70L breach said base side 74. Identical perimeters 73 of said depressions 71R, 71L are consistent with said conformation 69 of said rods 60R, 60L. (See FIGS. 13, 14) Holes 79R, 79L exist through a singular said leg side 78 to said depressions 71R, 71L. In the preferred embodiment, said drag 72 is fabricated out of material with desired rigidity strength characteristics.

Referring to FIGS. 17, 18, said brace 82 consists of said end 80R, said front side 85, said rear side 87, said top side 81, said bottom side 83, and an opposite end 80L, all of predetermined dimension. Latitudinal grooves 89R, 89L each disposed from said ends 80R, 80L breach said front 85, top 81, and rear 87 sides. Said grooves 89R, 89L have an interior perimeter 86 consistent with said tail segment 77T of said rods 60R, 60L. (See FIGS. 13, 14) Holes 88R, 88L exist through said bottom side 83 to said grooves 89R, 89L. In the preferred embodiment said brace 82 is fabricated out of material with desired rigidity strength characteristics.

Figure 19:
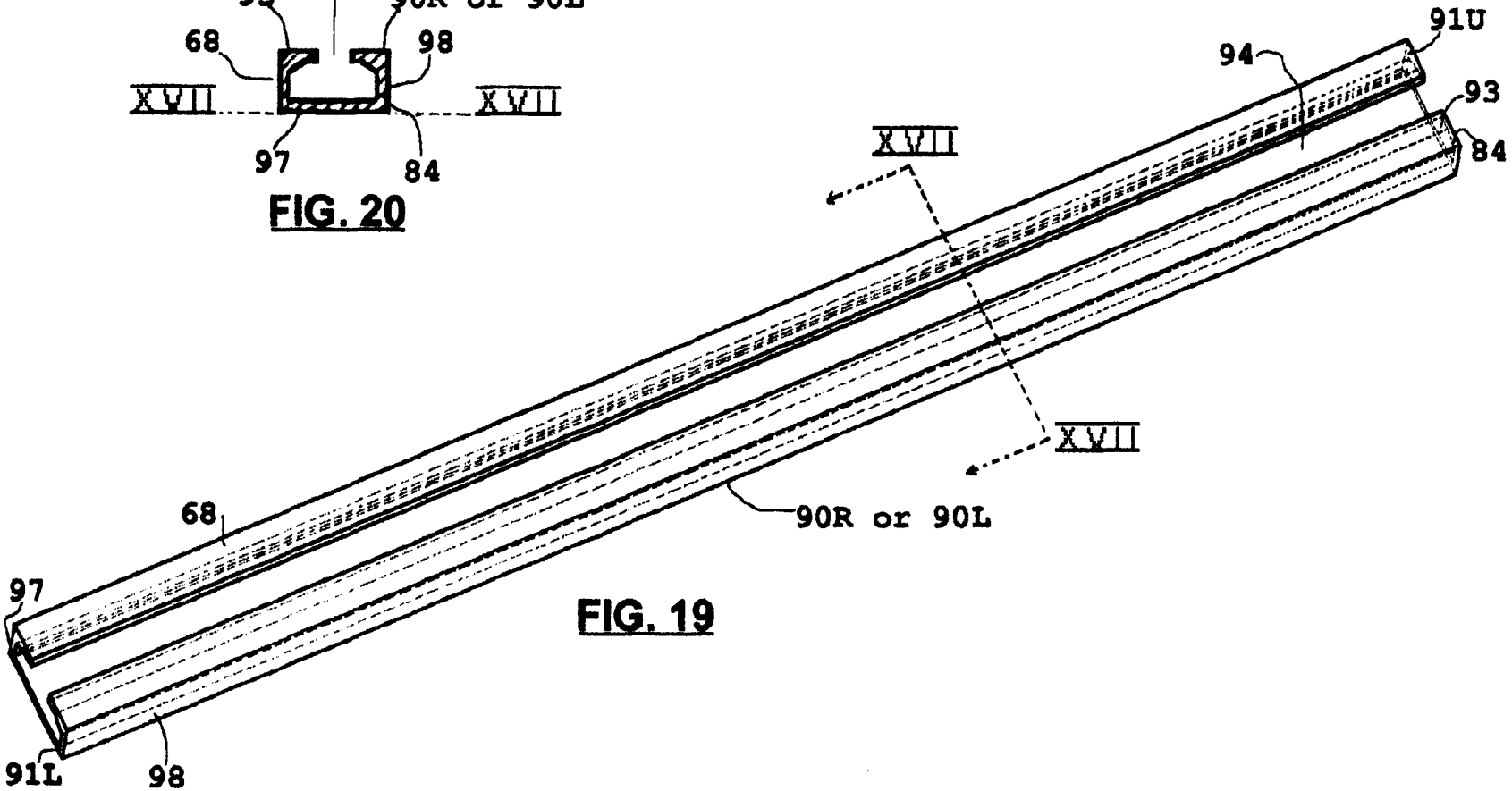
FIG. 19 is a perspective view of a part of the screen assembly shown in FIG. 1 and FIG. 3 laterally crossed by line XVII_XVII.
Figure 20:
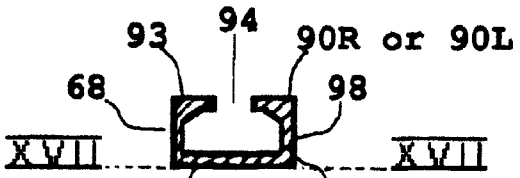
FIG. 20 is a cross-sectional view of FIG. 19 along line XVII_XVII.

Referring to FIGS. 19, 20, said slips 90R, 90L consist of said right side 98, a left side 68, said top side 93, said bottom side 97, and said ends 91L, 91U, all of predetermined dimension. Longitudinal groove 94 breaches said ends 91L, 91U, and said top side 93. An interior perimeter 84 of said groove is consistent with said tail segment 77T of said rods 60R, 60L. (See FIGS. 13, 14) In the preferred embodiment, said slips 90R, 90L will be fabricated out of material having the desired flexibility characteristics.

Advantages

An elevated track improves the screen assembly by allowing the track to traverse the entire height of a garage door over inherent garage door connecting and supporting means. Fabricating the components of material with desired flexibility, weight, and strength characteristics makes imperforate mounting possible, which does not decrease the energy efficiency of a garage as with perforate mounting. The use of a single screen panel to completely enclose a garage door opening, including an opening at top between garage door and header of door jam, is an improvement. The screen assembly is permanently stored against the interior side of a garage door, and can be manually deployed by a single individual. The screen panel with a large main portion provides ample advertising space for a personal billboard. The personal billboard marketing strategy increases the economic viability of the present invention.

Operation

The imperforate mounting of vertical track members 41R, 41L is made by use of an adhesive to secure bases 21R, 2I1, 31R, 31L disposed symmetrically in corners of a garage door. By using an abrasive, such as sandpaper, the contacting plate 23L, 23U and relative placement position on the garage door are scored to aid in bonding the two together. The symmetrical disposition of the bases 21R, 21L, 31R, 31L is such that the tracks 41R, 41L can be vertically positioned at opposite ends of the entire interior side of a garage door. Each vertical track 41R, 41L is slidably engaged to respective upper and lower bases, 21R, 31R or 21L, 31L, and fixedly held in place by a pin 28R 28L. The track 41R, 41L has a predetermined length, which is approximately equal to a garage door's height, a mushroom-shaped breaching bore 59, which encompasses the head 77H of a dual-purpose conjunctive rod 60R, 60L while allowing the tail 77T of rod 60R, 60L to pass outside track 41R, 41L. Reinforcement during fabrication of the track 41R, 41L, gives it a rigid stiffness at its raised engagement footings 42L, 42U with respective bases 21R, 31R or 21L, 31L. During operation of a garage door, where bends may be encountered, the rigid stiffness prevents a sufficient variance in the gauge 58 of the breaching bore 59 to lose integrity as a track. Said dual-purpose conjunctive rods 60L, 60R have respective said head portions 77H that slidably engage said vertical tracks 41L, 41R and respective said tail portions 77T that slidably engage said screen attachment slips 90L, 90RP Respective said head portions 77H are constant throughout most of the elongated rods 60L, 60R, except for an increase in dimension toward its lower end 63L, which acts as a wedge for releasably locking said rods 60L, 60R in said tracks 41L, 41R. Therefore, said upper ends 63U of respective said rods 60L, 60R and said lower ends 43L of respective said tracks 41L, 41R are both the first and last portions to slidably engage each other, and while still engaged, the extended rods 60L, 60R flex arcing from tracks 41L, 41R back toward a floor of garage. A horizontal drag 72 is fixedly attached to the lower ends 43L of respective said rods 60L, 60R to concert the rods 60L, 60R and engage a floor of garage. A horizontal brace 82 is fixedly attached to the tails 77T of respective said rods 60L, 60R approximately above the screen attachment slips 90L, 90R to generally fix the attachment slip 90L, 90R position and further concert the rods 60L, 60R. Attachment slips 90L, 90R or permanently mounted vertically at opposite end seams 37L, 37R of a main portion 99 of a single screen panel 95. Since the attachment slips 90L, 90R are each slidably attached to tail portions 77T of respective said rods 60L, 60R which are slidably engaged in the tracks 41L, 41R, the main portion 99 remains taught between the two rods 60L, 60R. The main portion 99 covers substantially the entire interior side of the garage door and has auxiliary portions 92L, 92R, and 96 attached respectively vertically at its sides and horizontally at its top. The auxiliary upper portion 96 folds over the horizontal brace 82 so the exterior faces 96E, 99E of respective upper and main portions 96, 99 face each other. When the concerted conjunctive rods 60L, 60R with single screen 95 attached extends arcing from vertical tracks 41L, 41R, the upper auxiliary portion 96 moves from an orientation disposed at the top panel 51U of garage door 50 to an orientation disposed at the bottom panel 51L of a garage door 50. When in a deployed condition, the upper portion 96 wraps around the bottom panel 51L of a garage door 50 attaching to an exterior of a garage (not shown) sealing an opening (not shown) between the bottom panel 51L and a door jam (not shown). Half of a hook and loop fastener 61 attached to the interior face 96I of the upper portion 96 connects to the corresponding half (not shown) attached to an exterior of a garage (not shown). The forward bowing, from the garage opening (not shown), exhibited by the extended rods 60L, 60R provides two half-cylindrical openings at the sides (not shown). The side openings (not shown) are sealed by corresponding halves of a hook and loop fastener with one half 61 respectively attached to the exterior faces 92E of side portions 92L, 92R and another half (not shown) to an interior of garage near a door jam (not shown).

Conclusion, Ramifications, and Scope of Invention

Thus the reader will see that the screen assembly of the present invention provides a flexible, highly reliable, storable, and lightweight device that can traverse the entire height of a garage door, mount without perforating a garage door, and be deployed by a single individual. While my above description contains many specificities, these should not be construed as limitations on the scope of the invention, but rather as an exemplification of one preferred embodiment thereof. other variations are possible. Many other variations are possible. For example, alternative embodiments may, (a) modify design to attach bases to a garage door, differently;
(b) configure the receiver wells of its bases, differently;
(c) include bases that provide means for screw tightening whereby a male helical screw portion and a female helical screw portion exist to secure a tower component;
(d) combine the base and tower components, so that a base's receiver well is more distant from its contacting plate;
(e) combine the base, tower, and track into a single part;
(f) change the shape of bore of the track;
(g) completely or partially separate the barrel from the towers;
(h) change the shape of either the head or tail segment of the rods or both;
(i) change the shape or section of the drag;
(j) change the shape or section of the brace;
(k) change the shape or section of the slips;
(l) change the shape or section of the pins;
(m) modify the design to include additional bases intermediate the height or ends of garage door to further support tracks at ends or add more tracks;
(n) modify the design to include means to prevent the rods from completely disengaging the tracks by sliding out;
(o) modify the design to include zippered throughway passages in main portion of single screen panel;
(p) modify the design to include a plurality of tie downs for side auxiliary screen portions.

Accordingly, the scope of the invention should be determined not by the embodiment(s) illustrated, but by the appended claims and their legal equivalents.

What is claimed is:

1. A retractable screen assembly in combination with an overhead garage door, which has an interior and an exterior side that are perpendicular to a floor of a garage in a fully or partially closed condition, and ends in a fully opened condition with the door substantially parallel to the floor of the garage, said assembly comprising:

a single panel of flexible porous material of predetermined dimension to selectively exclude environmental elements, a plurality of restricting means of predetermined dimension disposed vertically on said panel for restricting said panel during extending and retracting operation, a plurality of flexible tracks of predetermined dimension vertically disposed and offset parallel said interior side, a plurality of towers of predetermined dimension perpendicularly positioned in between said tracks and a connecting means for connecting said towers to said interior side, a plurality of flexible rods of predetermined dimension and a plurality of supporting members of predetermined dimension incorporate allowing said rods to slidably engage both said tracks and said restricting means, while said supporting members hold said restricting means in place, whereby said panel includes a main portion, that traverses substantially an entire height by width opening of said garage door, and supplementary portions at a top and ends of said main portion, that releasably fasten to said garage, whereby said towers are disposed symmetrically on said interior side to dispose said tracks vertically and to provide said tracks unimpeded traversal of entire height of said interior side, whereby said rods are of a length greater than the length of said tracks, whereby a portion of a cross section of said rods is received by said tracks while a remainder of said cross section of said rods remains outside said tracks, thereby distinguishing a middle-narrowing characteristic of said cross section of said rods, whereby at least one said supporting member engages said floor of said garage, whereby said rods alternate between an extended condition where said rods telescope from said tracks, bend through said open condition, and enclose the opening with said main, end, and top portions and a retracted condition where said rods remain seated in said tracks.

2. The assembly of claim 1 further including an advertising expression bonded with said main portion.

3. The assembly of claim 1 wherein the predetermined dimension of said tracks and said rods allow said rods to remain in the retracted condition by wedging said rods into said tracks.

4. The assembly of claim 1 wherein said towers, said connecting means, and said tracks are fabricated of extruded plastic.

5. A retractable screen assembly in combination with a singled paneled overhead garage door, that ends in a fully opened condition with an interior side of said door substantially parallel to a floor of a garage, where said door is either fully open or fully closed, said assembly comprising:

a barrier means 95, of predetermined dimension to selectively exclude environmental elements, a plurality of restricting means 90R, 90L, of predetermined dimension, are vertically disposed on said barrier means for restricting said barrier means during extending and retracting operation, a plurality of guide means 41R, 41L, of predetermined dimension, for guiding said barrier means, are vertically disposed and offset parallel said interior side, a plurality of elevation means 44L, 44U of predetermined dimension, for offsetting said guide means, are perpendicularly interposed said guide means and a connection means 21L, 21R, 31L, 31R for connecting said elevation means to said interior side, a plurality of delivering means 60R, 60L, of predetermined dimension for delivering said barrier means, and a plurality of concerting means 72, 82, of predetermined dimension for supporting said delivering means, incorporate allowing said delivering means to slidably engage both said guide means and said restricting means, while said concerting means hold said restricting means in place, whereby said barrier means includes a main portion, that traverses substantially an entire height by width opening of said garage door, and supplementary portions at a top and ends of said main portion that releasably fasten to said garage, whereby said elevation means are disposed symmetrically on said interior side to dispose said guide means vertically and to provide said guide means unimpeded traversal of an entire height of said interior side, whereby said delivering means are of a length greater than the length of said guide means, whereby a portion of a cross section of said delivering means is received by said guide means while a remainder of said cross section of said delivering means is outside said guide means, thereby distinguishing a middle-narrowing characteristic of said cross-section of said delivering means, whereby at least one of said concerting means engages said floor of said garage, whereby said delivering means alternate between an extended condition where said delivering means telescope from said guide means, bond through said open condition, and enclose the opening with said main, end, and top portions and a retracted condition where said delivering means remain seated in said guide means.

6. The assembly of claim 5 wherein said connecting means include adhesive means for bonding a surface of said connecting means to said interior side without peforating said interior side.

7. The assembly of claim 6 wherein said connecting means include adhesive means for bonding a surface of said connecting means to said interior side without perforating said interior side.

8. The assembly of claim 6 further including an advertising expression bonded with said main portion.

9. The assembly of claim 6 wherein the predetermined dimension of said guide means and said delivering means allow said delivering means to remain in the retracted condition by wedging said delivering means into said guide means.

10. The assembly of claim 6 wherein said elevation means, said connecting means, and said guide means are fabricated of extruded plastic.

* * * * *